United States Patent [19]

Uhl

[11] 4,364,143

[45] Dec. 21, 1982

[54] PAINT ROLLER ATTACHMENT DEVICE

[76] Inventor: Jack Uhl, 400 Lido Dr., Fort Lauderdale, Fla. 33301

[21] Appl. No.: 224,835

[22] Filed: Jan. 13, 1981

[51] Int. Cl.[3] ..... B05C 17/02; A46B 5/02

[52] U.S. Cl. ..... 15/145; 15/230.11

[58] Field of Search ..... 15/143 R, 144 R, 144 A, 15/144 B, 145, 230.11; 29/110.5; 248/359

[56] References Cited

U.S. PATENT DOCUMENTS

| | | | |
|---|---|---|---|
| 414,527 | 11/1889 | Gwyn | 15/246 |
| 2,309,990 | 2/1943 | Savi | 15/246 UX |
| 3,197,169 | 7/1965 | Burrows | 248/359 |
| 3,231,919 | 2/1966 | MacDonald | 15/174 |
| 3,832,749 | 9/1974 | Hawk | 15/230.11 |
| 4,263,690 | 4/1981 | Dobosi | 15/230.11 X |

*Primary Examiner*—Robert L. Bleutge

*Attorney, Agent, or Firm*—Harness, Dickey & Pierce

[57] ABSTRACT

An attachment device for facilitating the use and/or storage of a paint roller handle having a male threaded end which is adapted to extend into the female threaded opening of the handle, a hook portion which will prevent the handle from falling into the paint and the roller from entering into the trough of the tray and a female threaded opening which permits the attachment of an extension handle.

7 Claims, 2 Drawing Figures

13
14
27
23
24
25
26
19
12
21
18
17
16
15
11

14
24
25
26
27

PAINT ROLLER ATTACHMENT DEVICE

BACKGROUND OF THE INVENTION

This invention relates to an attachment device for facilitating the use and/or storage of a paint roller handle.

The use of paint rollers as tools for applying paint is well known. Almost as well known is the problems connected with such devices in that when the user places the roller into the tray during a period when it is not being used, the roller has a tendency to roll into the tray so that it becomes immersed in the paint and the handle contacts the sloping portion of the tray and picks up paint. Although this problem is well known, there have been no satisfactory and yet simple solutions to it.

The handles of paint rollers are formed with standard female threaded openings so as to permit the attachment of extension handles. In accordance with this invention, this female threaded opening is used to receive an attachment device which serves the dual purpose of preventing the roller from becoming immersed in the paint when it is not being used and also which permits convenient storage of the roller and handle assembly. This object is achieved without detracting from the ability of using an extension handle and without necessitating removal of the attachment device.

SUMMARY OF THE INVENTION

This invention is adapted to be embodied in an attachment device for facilitating the use and/or storage of a paint roller handle or the like. The handle is adapted to carry a roller at one of its ends and is formed with a female threaded opening at its other end to receive the threaded end of an extension handle. The attachment device comprises a body having male threaded end complimentary to the female threaded opening of the handle for a screw attachment of the body to the handle. A hook portion extends from the body and is configured to co-act with the edge of an associated paint tray when the handle is placed upon the tray to retain the handle from rolling along the tray and the roller from becoming immersed in the paint.

DETAILED DESCRIPTION OF THE PREFERRED EMBODIMENT

Figures 1, 2:
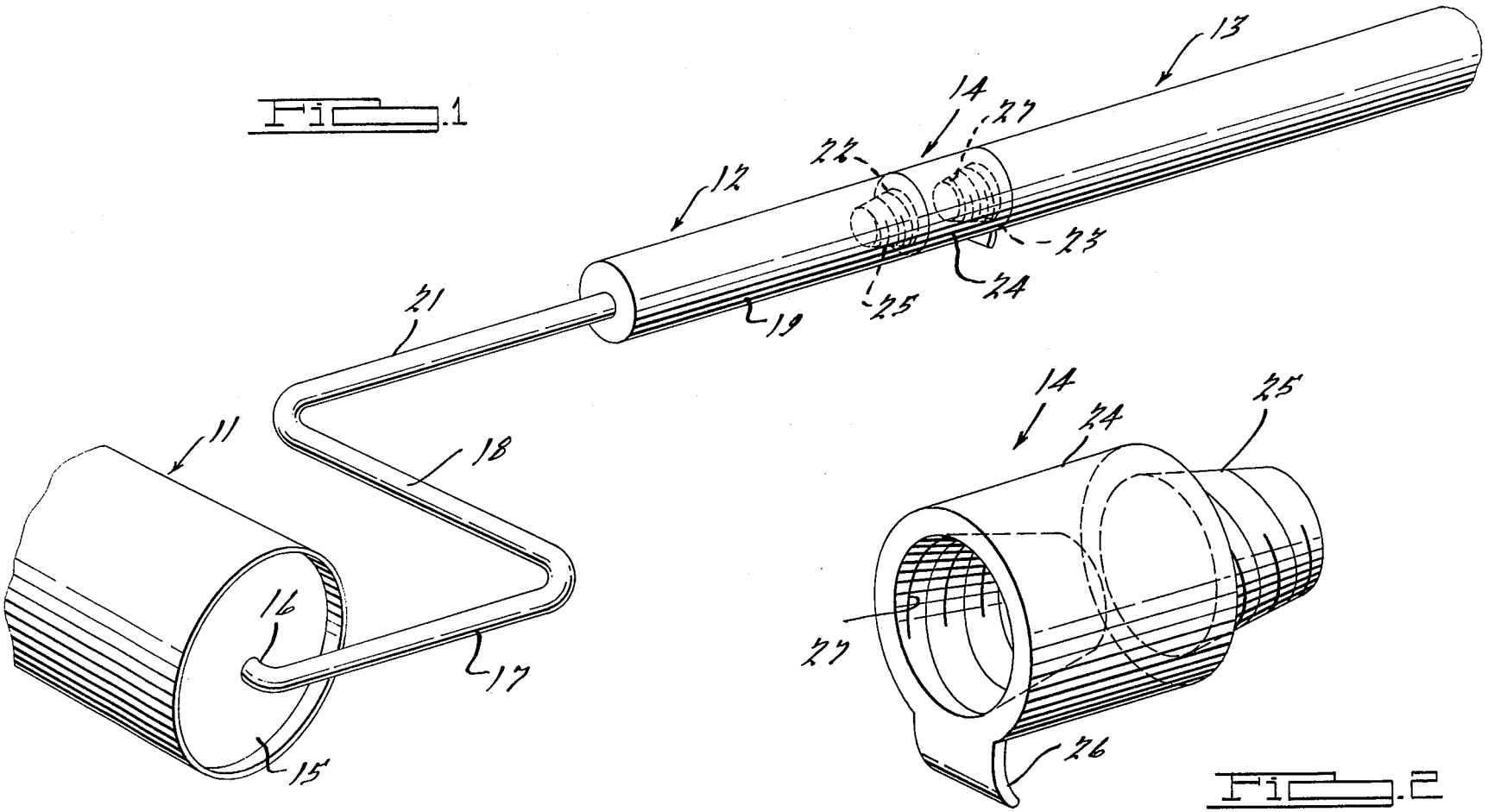
FIG. 1 is a perspective view of a paint roller, extension handle and attachment device constructed in accordance with the invention.
FIG. 2 is an enlarged perspective view of the attachment device looking from the end opposite that in FIG. 1.

In FIG. 1 there is illustrated a paint roller 11, a supporting handle 12, an extension handle 13, and an attachment device embodying this invention 14. The roller handle 12, as is conventional, includes a roller 15 which is journaled on an outer arm 16 of the handle 12. The arm 16 extends from an intermediate portion 17 which, in turn, extends from an offset arm 18 which is parallel to the arm 16 and which is connected to a handle 19 by means of a longitudinally extending portion 21. The handle 19 may be formed of any suitable material and, as is common with such devices, has a female threaded opening 22 formed in its outer end. The opening 22 is provided so that extension handles 13 may be interposed with their male threaded ends 23 in the opening 22 so as to afford greater versatility in the use of the roller 11 and handle 12. Such extensions are frequently used for permitting access to hard-to-reach places such as ceilings or the like.

As is well know, when the handle 12 and roller 11 are placed in the associated tray (not shown) during rest periods, the roller 11 has a tendency to roll down the tray so that it becomes immersed in the paint collected in the trough at the lower portion of the tray. This is particularly undesirable since it wastes paint and makes it difficult to apply paint without splattering. In addition, the handle portion 19 may fall onto the inclined surface of the tray and itself become coated with paint. To avoid this difficulty, permit convenient storage of the roller 11 and handle assembly 12, and still afford the use of extension handles, the attachment device is provided.

The attachment device 14 is a generally cylindrical element which may formed from plastic, wood or other similar materials. The device 14 has a cylindrical body 24 from which a male threaded end 25 extends. The threads 25 are complimentary to the handle opening 22 so that the device 14 may be conveniently screwed into the handle assembly 12.

A hook-like portion 26 is formed integrally at the end opposite the threads 25 and extend for sufficient distance so that it may be placed in engagement with the lip of the associated tray to hold the roller 11 and the handle assembly 12 in position so that the handle portion 19 will not engage the inclined surface of the tray and the roller 11 will not be positioned in the trough of the tray. The hook 26 also may be used to co-act with a suitable storage device or over the edge of a shelf or the like so as to permit hanging of the assembly 12 and associated roller 11 for either storage and/or cleaning purposes.

Adjacent the hook 27, the device 14 is formed with a female threaded opening 27 of the same size and shape as the handle opening 22. In this way, extension handle portions 13 may have their ends 23 threaded into the opening 27 so as to permit their use without necessitating removal of the device 14.

It should be readily apparent that the disclosed attachment device enhances painting with the roller, affords a convenient way for storing it, and does not interfere with the use of extension handles or the like. The device 14 is also sufficiently small so that it can be made low in cost and can be sold either along with handle assemblies 12 or as accessory units for them.

It is to be understood that the foregoing description is that of a preferred embodiment of the invention and that various changes and modifications may be made without departing from the spirit and scope of the invention as defined by the appended claims.

I claim:

1. An attachment device for facilitating the use and/or storage of a paint roller handle or the like which handle is adapted to carry a roller or the like at one of its ends and which has a female threaded opening at the other end to receive the male threaded end of an extension handle, said attachment device comprising a body substantially shorter than the handle and having a male threaded end complimentary to the female threaded opening of the handle for screw attachment of said body to the handle and a hook portion extending from said body and configured to co-act with the edge of an associated paint tray when the associated handle is placed thereupon to retain the handle from rolling along the tray, said hook portion being sized and located so as not to interfere with the grasping of the handle by a user.

2. An attachment device as set forth in claim 1 wherein the attachment device is integrally made up of male threaded end, body portion and hook portion.

3. An attachment device as set forth in claim 2 wherein a hook portion is configured so as to serve for suspending the handle or the like.

4. An attachment device as set forth in claim 1 further including a female threaded opening formed on the end of the body opposite the male threaded end.

5. An attachment device as set forth in claim 4 wherein the attachment device is integrally made up of male threaded end, body portion and a hook portion.

6. An attachment device as set forth in claim 5 wherein a hook portion is configured so as to serve for suspending the handle or the like.

7. An attachment device as set forth in claim 6 wherein the attachment device is formed from a molded plastic and the hook portion is formed in the end adjacent the female threaded opening.

* * * * *